United States Patent [19]

Shigemura

[11] 4,162,889

[45] Jul. 31, 1979

[54] METHOD AND APPARATUS FOR CONTROL OF EFFICIENCY OF COMBUSTION IN A FURNACE

[75] Inventor: Michael S. Shigemura, Cupertino, Calif.

[73] Assignee: Measurex Corporation, Cupertino, Calif.

[21] Appl. No.: 903,942

[22] Filed: May 8, 1978

Related U.S. Application Data

[63] Continuation-in-part of Ser. No. 750,391, Dec. 14, 1976, abandoned.

[51] Int. Cl.[2] ..... F23N 5/18

[52] U.S. Cl. ..... 431/76

[58] Field of Search ..... 431/12, 76

[56] References Cited

U.S. PATENT DOCUMENTS

| | | | |
|---|---|---|---|
| 3,549,089 | 12/1970 | Hamlett | 431/12 |
| 3,602,487 | 8/1971 | Johnson | 431/12 |
| 3,607,117 | 9/1971 | Shaw et al. | 431/12 |
| 3,723,047 | 3/1973 | De Livois | 431/76 |
| 3,734,675 | 5/1973 | Osburn | 431/12 |
| 3,894,832 | 7/1975 | Chin et al. | 431/12 |

*Primary Examiner*—Carroll B. Dority, Jr.
*Attorney, Agent, or Firm*—Ronald L. Yin

[57] ABSTRACT

A feed forward system coupled with a feed back system is used to control the efficiency of combustion of fuel in a furnace. The feed forward system has sensors to measure the fuel flow rate and the quality of the fuel. The measurement of the sensors is used to calculate the theoretical oxygen flow rate needed to combust the fuel. The theoretical oxygen flow rate and an excess oxygen level are used to determine the actual air flow rate, which is used to control the air input to the furnace. The feedback system has a sensor to detect combustibles near the exhaust of the furnace. The measurement of the combustible sensor is used to control the excess oxygen level. In a preferred embodiment, another sensor, an oxygen sensor, is placed near the exhaust of the furnace. The oxygen sensor provides a dynamic check on the actual amount of excess oxygen level within the furnace. Finally, the oxygen sensor is also used as a safety device in providing redundancy to the combustible sensor.

6 Claims, 2 Drawing Figures

METHOD AND APPARATUS FOR CONTROL OF EFFICIENCY OF COMBUSTION IN A FURNACE

This application is a continuation-in-part of a copending application 190 750,391 filed on Dec. 14, 1976, now abandoned, by the present inventor and assigned to the same assignee.

BACKGROUND OF THE INVENTION

The present invention relates to controlling the efficiency of combustion of fuel in a furnace and more particularly to the control of the efficiency of combustion of fuel in a furnace where the rate of flow of the fuel or the quality of the fuel may vary considerably over a period of time.

In general, a furnace has a fuel input, an air input and an exhaust output. The fuel and air, more specifically the oxygen in the air, are mixed and combusted within the furnace to liberate energy—mostly in the form of heat. The result of this combustion (chemical reaction) is energy and waste, for example carbon dioxide, and is removed through the exhaust output.

Fuel is typically hydrocarbons (chemicals composed of mostly carbon and hydrogen atoms). It has been long recognized from basic chemistry that for a given hydrocarbon a theoretical number of oxygen atoms is required for complete combustion of that hydrocarbon (e.g. a carbon atom requires two oxygen atoms to result in carbon dioxide). Since oxygen is a near constant proportion of air, the figure for the theoretical amount of oxygen can be transformed into a figure for the theoretical amount of air. Clearly, the furnace would not be operating efficiently if the amount of air into the furnace were below the theoretical amount. Fuel or combustibles, which can be translated into dollars and cents, would literally exit from the stack of the furnace. Moreover, this could create a very explosive condition, if the amount of combustibles were high.

On the other hand, it is not desirable to operate the furnace with an unlimited amount or excessive amount of air. Oxygen is only a small fraction (about 20%) of total air. Typically, air enters the furnace at ambient temperature of about 65° F. At the exhaust output, the gaseous wastes, such as carbon dioxide, and the other gaseous components of air (mainly nitrogen) which do not enter into the combustion process, exit at an elevated temperature of about 350° F. Thus, for every volume of air which is taken in at the air input, energy is wasted on about eighty percent of that volume of air in raising it to the elevated temperature at the exhaust output. It is known that for the most efficient operation of a furnace a limited amount of oxygen in excess of the theoretical amount of oxygen (or air) is required. Operation of the furnace above or below this excess amount of oxygen would cause the furnace to operate away from peak efficiency. However, the desired excess amount of oxygen for maximum efficient operation of the furnace varies as a function of the type and quality of fuel used. For example, natural gas may require only 2% excess oxygen for near peak efficient combustion while coal may require 8% excess oxygen.

After the combustion of fuel, the heat, which is liberated, is used for a variety of purposes, all of which can be generically termed as the load. A typical load is the use of heat to generate steam. Where the load is a constant, the amount of heat generated per unit time is also a constant. Consequently, the fuel flow rate is also a constant. Under such condition, the air flow rate can be adjusted, through trial and error, to obtain the most efficient operating point of the furnace for the particular fuel used.

In many industrial processes, however, the load is not a constant. Demand may vary by as much as 5% per minute in a typical paper processing plant. The variation in load would cause a variation in the heat produced per unit time. This can be accomplished by changing the fuel flow rate or by changing the type or quality of fuel used. In such environment, variations of such magnitude make the trial and error method totally useless.

Heretofore, one method of controlling the efficiency of combustion in a furnace is taught by U.S. Pat. No. 3,602,487 which uses an oxygen sensor at the stack (exhaust output) to detect the amount of oxygen leaving the stack. The amount of oxygen leaving the stack is excess oxygen, because the amount is more than that needed for complete combustion. The control of combustion based upon the detection of excess oxygen, however, would suffer the deficiencies as previously noted. Another method is taught by U.S. Pat. No. 3,723,047, which uses a combustible sensor to detect the combustibles level at the stack.

SUMMARY OF THE INVENTION

In an system for controlling the efficiency of combustion of fuel in a furnace, with a fuel input, an air input, and an exhaust output, and operating near peak efficiency as determined by an excess oxygen level, the system is responsive to changes in the flow rate or the quality of the fuel to restore the operation of the furnace to its near peak efficiency. The system comprises a feedforward subsystem and a feedback subsystem. The feedforward subsystem comprises means for computing the theoretical oxygen flow rate required to combust the flow rate and the quality of fuel at the fuel input. The actual air flow rate is calculated based upon the theoretical oxygen flow rate and the excess oxygen level. The flow rate of air at the air input is controlled based upon the calculation of the actual air flow rate. In the feedback subsystem, means for detecting the amount of combustibles is located near the exhaust output. The excess oxygen level is adjusted in response to the combustible detecting means.

In a method for restoring the operation of a furnace to its near peak efficiency as determined by an excess oxygen level, wherein the furnace has an air input, a fuel input and an exhaust output, and is subject to changes in the flow rate of the fuel or the quality of the fuel, the method comprises calculating the theoretical oxygen flow rate needed to combust the flow rate and the quality of the fuel. The theoretical oxygen flow rate and the excess oxygen level are used to compute the actual air flow rate. The actual air flow rate is used to control the flow rate of air at the air input. The amount of combustibles is detected at the exhaust output and the excess oxygen level is adjusted in response to the amount of combustibles detected.

DETAILED DESCRIPTION OF THE DRAWINGS

Figure 1:
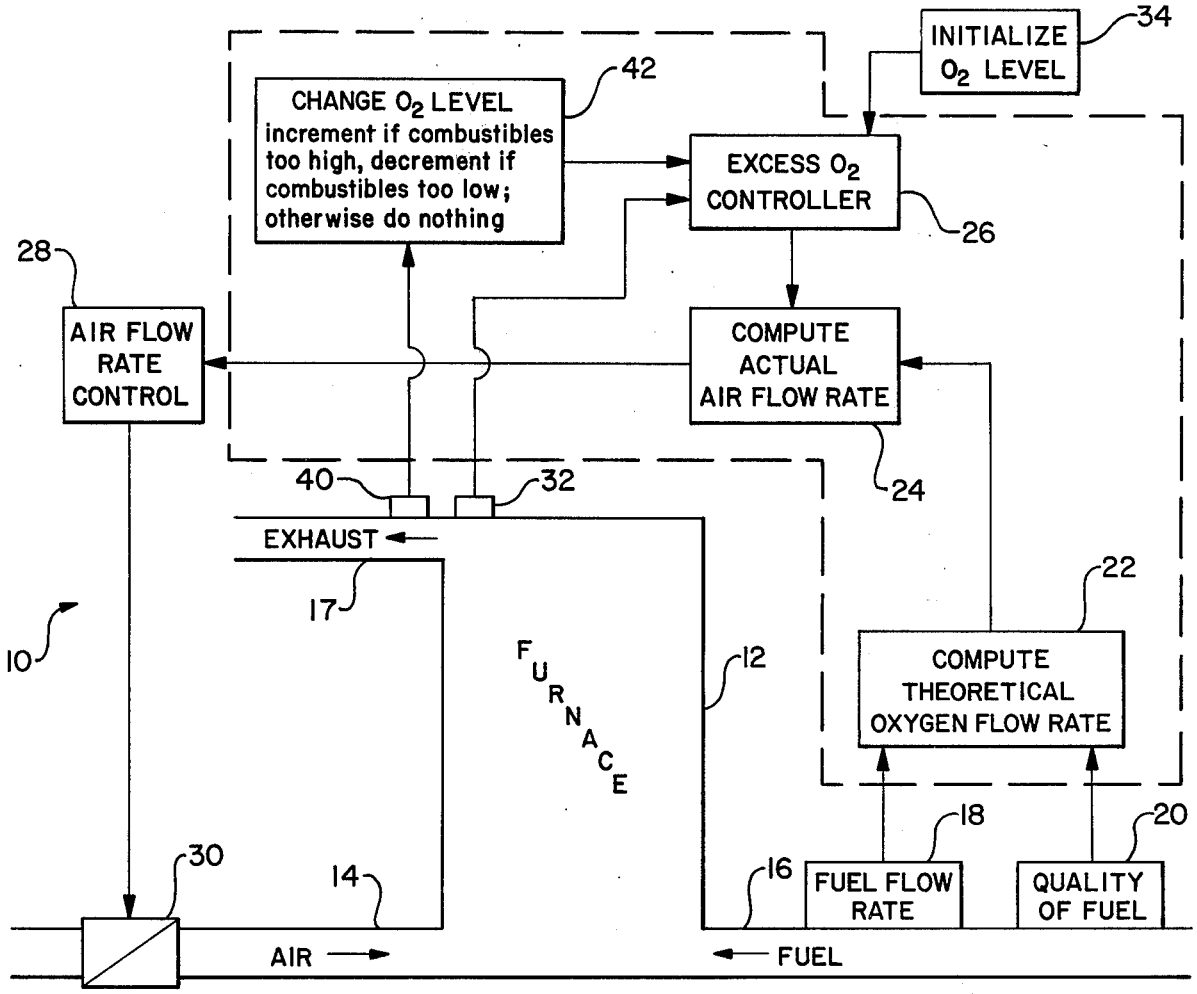
FIG. 1 is a schematic diagram of the system of the present invention used with a furnace.

Referring to FIG. 1, there is shown a schematic diagram of a system 10 of the present invention used with a furnace 12. The furnace 12 has air input 14, fuel input 16 and exhaust output 17. The system 10 comprises two subsystems: a feedforward subsystem and a feedback subsystem.

The feedforward subsystem comprises a fuel flow rate sensor 18 and a fuel quality sensor 20. The flow rate sensor 18 and the quality sensor 20 each produce a signal which is entered into an oxygen calculator 22. The oxygen calculator 22 calculates the amount of oxygen per unit time required for theoretical complete combustion of the fuel flowing through the fuel input 16. The result of the computation of the oxygen calculator 22 is a signal which is entered into an air calculator 24. An excess oxygen controller 26 contains the value of an excess oxygen level, which is stored at some convenient location, such as the memory of a computer. The value of excess oxygen controller 26 is also entered into the air calculator 24. The result of the computation of the air calculator 24 is a signal which is entered into an air flow rate controller 28 which in turn adjusts a final control element 30, regulating the amount of air into the air input 14. In the preferred embodiment an oxygen sensor 32, placed near the exhaust output 17 of the furnace 12, is used to determine the oxygen level at the exhaust output 17, which corresponds approximately to the excess oxygen level within the furnace 12. The reading of the oxygen sensor 32 is entered into the excess oxygen controller 26. Alternatively, the excess oxygen level desired at excess oxygen controller 26 can be initially manually entered by an operator through an operator's console 34.

The fuel flow rate sensor 18 can be any conventional flow meter, such as a magnetic flow meter; it determines the rate of flow of fuel through the fuel input 16. The quality sensor 20 estimates the quality of fuel flowing through the fuel input 16; it can be manually entered by an operator or can be the output of a sensor, such as a moisture sensor. As used herein, the term quality of the fuel also refers to the type of fuel, such as oil or gas. Thus, the expression quality of fuel means the type as well as concentration of the fuel. The oxygen calculator 22 calculates the theoretical oxygen needed for complete combustion. As is known from chemistry, for a given type of fuel, a theoretical number of $O_2$ molecules are needed. For example, $C_5H_{12}$ requires eight (8) $O_2$ molecules for complete combustion based upon the following reaction:

$$C_5H_{12}+8\ O_2 \rightarrow 5CO_2+6H_2O$$

The flow rate of that fuel, based upon the reading sensed by the flow rate sensor 18, determines the flow rate of $O_2$ required for theoretical complete combustion. For example, if $C_5H_{12}$ were sensed to flow at 5 moles/sec. then the theoretical amount of $O_2$ required would be 8 moles $O_2$/mole fuel $\times$ 5 moles fuel/sec = 40 moles $O_2$/sec. (This assumes that the quality of the fuel is 100% $C_5H_{12}$). The excess oxygen level at excess oxygen controller 26 is a value of the amount of $O_2$ molecules in a given volume to the total number of gas molecules in that volume. Typically, it is a fraction. The value at excess oxygen controller 26 can be the output reading of an oxygen sensor 32, such as an electrochemical device or the value can be manually entered through an operator's console 34. The air calculator 24 computes the actual air needed for efficient combustion of fuel flowing through the fuel input 16. The theoretical oxygen flow rate is increased by the excess oxygen level to reach an actual oxygen flow rate, which is then converted into an actual air flow rate. For example, if it were desired to operate the combustion of $C_5H_{12}$ with 5% oxygen more than the theoretical amount, then 40.0 moles $O_2$/sec. $\times$(1.05) = 42.0 moles $O_2$/sec. Based upon the approximation that oxygen is twenty percent (20%) of air, the actual air flow rate would be 210.0 moles/sec. The air flow rate controller 28 uses this figure to adjust control element 30 to reach the proper setting.

In the feedback subsystem, a combustible sensor 40 is located near the exhaust output 17 of the furnace 12. The combustible sensor 40 produces a signal which is entered into a comparator 42. The comparator 42 compares the value of the amount of combustibles detected by combustible sensor 40 to the amount of combustibles which represents the peak efficiency of operation of the furnace 12. (As will be discussed later, even at peak efficiency, the amount of combustibles would not be zero). If the amount of combustibles detected exceeds the amount which represents the peak efficiency of operation, then the comparator 42 sends a signal to excess oxygen controller 26 to increase the value of excess oxygen level. If the amount of combustibles detected is below the amount which represents the peak efficiency of operation, then the comparator 42 sends a signal to excess oxygen controller 26 to decrease the value of excess oxygen level; otherwise, the comparator 42 indicates to do nothing. The adjustment to the value of excess oxygen level as represented by excess oxygen controller 26 will eventually be used in the air calculator 24 which would change the air flow rate controller 28 and ultimately the amount of air through the element 30 in the air input 14.

The combustible sensor 40 can be a carbon monoxide detector, such as an ultraviolet CO analyzer. The comparator 42 can be hard wire logic with a stored value for the peak efficiency of operation of the furnace. All of the elements shown in the dash line can be a general purpose digital computer or a part thereof with appropriate software instructions.

Figure 2:
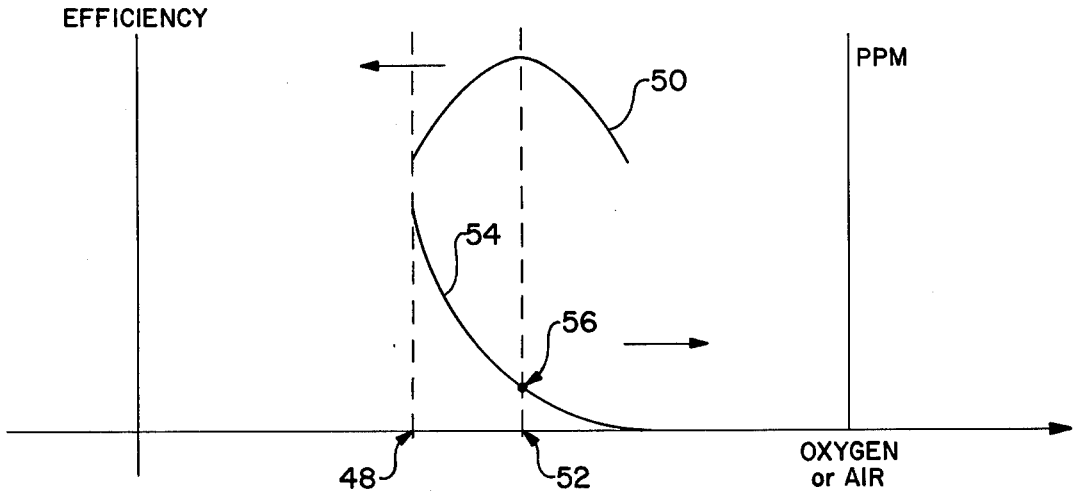
FIG. 2 are plots of combustion efficiency and combustibles detected, each as a function of oxygen or air in the furnace.

The theory of operation and the advantages of the present system and method can be seen by referring to FIG. 2. The x-axis of FIG. 2 represents the amount of air or oxygen into the furnace 12.

Point 48 is the oxygen required for theoretical complete combustion of a particular fuel. Curve 50 is a plot of combustion efficiency for that particular fuel as a function of air. As can be seen, the most efficient point is at 52. The difference between the most efficient point 52 and the theoretical point 48 is the excess oxygen level required for peak efficient operation of the furnace 12. Curve 54 is a plot of combustibles detected as a function of air. At the most efficient point 52, the amount of combustibles should read a value shown by point 56. While this value is non-zero, it is small (on the order of few parts per million —ppm—). To achieve zero combustibles detected at the exhaust output 17, it would require an inordinate amount of air, which would lower the efficiency of the furnace 12. The non-zero value of combustibles detected, even at the most efficient point, is due to quantum statistical nature of chemical reaction. From quantum statistics, it can be shown that a small fraction of atoms or molecules in a reaction would react only at extreme availability of reactants. It is imperative to remember that the curves 50 and 54 and points 48 and 52 are true for only a particular fuel used. A different fuel will result in different set of curves and points, albeit the shape of those curves would be similar to those shown in FIG. 2. However, for a different fuel, although the operating points of 48 and 52 would be different, the level of combustibles detected at the most efficient point would be approximately the same as the value 56. Thus, in the apparatus and method of the present invention, the combustible sensor 40 is used to detect the amount of combustibles at the exhaust output 17 and to adjust the air intake level until the peak efficient operating point of the furnace 62 is reached—irrespective of the quality of fuel or the flow rate of the fuel.

The feedforward subsystem is needed for initial adjustment on the amount of air required for a change in the quality or flow rate of the fuel. Moreover, this is needed for safety reasons. Between the air input 14 and fuel input 16 and exhaust output 17 lies a time lag of about three (3) minutes. If the amount of fuel through the fuel input were suddenly increased by a large amount (e.g. 50%) without a corresponding increase in air intake, the unburnt fuel within the furnace would create a most dangerous condition indeed. Thus, the feedforward system provides an initial adjustment on the air intake. As a further safety precaution, the oxygen sensor at the exhaust output 17 is used to monitor the excess oxygen level within the furnace 12. (If there are still oxygen molecules left at the exhaust output 17 after having passed through the furnace 12, then the molecules are excess within the furnace 12). The reading of the oxygen sensor 32 is used to check the value of excess oxygen level at excess oxygen controller 26. Moreover, because of the potential hazards of operating the furnace 12 with excessive fuel and in the event of the failure of either the combustible sensor 40 or the oxygen sensor 32 to detect this condition, the oxygen sensor 32 and the combustible sensor 40 provide a backup safety device to one another.

It should be noted that the advantage of the present system and method is the automatic and quick restoration of the operation of the furnace to near peak efficiency with a subsequent saving in fuel. In addition, furnaces in the past have operated with a high amount of excess oxygen to ensure that the furnace would not reach a dangerous condition caused by lack of oxygen. By controlling the operation of the furnace to a limited amount of excess air, the capacity of the furnace is also increased.

Finally, by controlling directly only the excess oxygen controller 26 (which indirectly controls the air calculator 24), the present invention insures that there will always be at least sufficient air for theoretical combustion. Even if the combustible sensor 40 and/or the oxygen sensor 32 were to fail causing the excess oxygen controller 26 to have a zero value, the air calculator 24 would still compute an amount of air based upon the theoretical oxygen for complete combustion from the oxygen calculator 22. Thus, the present invention provides yet another added safety feature. Furthermore, by having a known value of excess oxygen level stored in the excess oxygen controller 26, a direct computational analysis of the trade off between efficiency of operation and cost of fuel can be made. For example, natural gas may require only 2% excess oxygen for near peak efficient combustion while coal may require 8% excess oxygen. Even operating both fuels at peak efficiency, if coal were used, it would waste more heat than gas because part of the heat liberated must be used to raise more air from ambient temperature to elevated temperature. Yet, coal may be preferred because of its lower cost. The efficiency of combustion can be weighed against the cost of fuel. Thus, the present invention provides yet another feature in cost savings in the combustion of fuel.

What is claimed is:

1. A system to control the efficiency of combustion of fuel in a furnace, said furnace having a fuel input, an air input, and an exhaust output, and operating near peak efficiency as determined by an excess oxygen level, said system responsive to changes in the flow rate of the fuel or the quality of the fuel to restore the operation of said furnace to near peak efficiency, comprises: A feedforward subsystem having:

means for computing a theoretical oxygen flow rate needed to combust the flow rate and quality of said fuel;

means for calculating an actual air flow rate based upon said theoretical oxygen flow rate and said excess oxygen level;

means for controlling the flow rate of air at the air input, in response to said actual air flow rate;

A feedback subsystem having:

means for detecting the amount of combustibles at the exhaust output; and means for adjusting the excess oxygen level in response to said detecting means.

2. The system of claim 1 wherein said adjusting means comprises:

means for increasing the excess oxygen level if the amount of combustibles is greater than a desired level corresponding to a near peak efficiency; and means for decreasing the excess oxygen level if the amount of combustibles is less than a desired level, corresponding to a near peak efficiency.

3. The feedforward subsystem of claim 2 further comprising means for sensing the oxygen level at the exhaust output; and means for setting said excess oxygen level to the value determined by said sensing means.

4. An apparatus to control the efficiency of combustion of fuel in a furnace, said furnace having a fuel input, an air input and an exhaust output said apparatus having an operator input for initializing an excess oxygen level value and a value for the quality of fuel flowing through said fuel input, comprising:

means for measuring the flow rate of fuel flowing through said fuel input;

means for computing the theoretical oxygen flow rate required to combust the flow rate and quality of said fuel;

means for calculating the actual air flow rate required based upon said theoretical oxygen flow rate and said excess oxygen level;

means for controlling the air at the air input in response to said actual air flow rate;

means for monitoring the amount of combustibles at the exhaust output; and means for adjusting the excess oxygen level in response to said monitoring means.

5. The apparatus of claim 4 further comprising:

means for sensing the amount of oxygen at the exhaust output; and means for changing said excess oxygen level to said amount sensed.

6. The apparatus of claim 5 further comprising:

means for determining the quality of fuel flowing through said fuel input; and means for setting the quality of fuel value to said quality determined.

* * * * *